US009806432B2

(12) United States Patent
Little et al.

(10) Patent No.: US 9,806,432 B2
(45) Date of Patent: Oct. 31, 2017

(54) DUAL-POLARIZED WIDEBAND RADIATOR WITH SINGLE-PLANE STRIPLINE FEED

(71) Applicant: Raytheon Company, Waltham, MA (US)

(72) Inventors: Matthew P. Little, Harvard, MA (US); David R. Kralj, Marlborough, MA (US); Landon L. Rowland, Westford, MA (US); Jacquelyn A. Vitaz, Medford, MA (US)

(73) Assignee: Raytheon Company, Waltham, MA (US)

( * ) Notice: Subject to any disclaimer, the term of this patent is extended or adjusted under 35 U.S.C. 154(b) by 43 days.

(21) Appl. No.: 14/956,604

(22) Filed: Dec. 2, 2015

(65) Prior Publication Data

US 2017/0162950 A1 Jun. 8, 2017

(51) Int. Cl.

| | |
|---|---|
| ***H01Q 21/06*** | (2006.01) |
| ***H01Q 13/08*** | (2006.01) |
| ***H01Q 21/24*** | (2006.01) |
| ***H01Q 13/10*** | (2006.01) |
| ***H01Q 21/00*** | (2006.01) |
| ***H01Q 1/50*** | (2006.01) |

(52) U.S. Cl.

CPC ..... *H01Q 21/24* (2013.01); *H01Q 1/50* (2013.01); *H01Q 13/10* (2013.01); *H01Q 21/0075* (2013.01)

(58) Field of Classification Search

CPC ..... H01Q 13/08; H01Q 21/06; H01Q 21/24

See application file for complete search history.

(56) References Cited

U.S. PATENT DOCUMENTS

| | | | | |
|---|---|---|---|---|
| 5,268,701 | A | 12/1993 | Smith | |
| 5,880,694 | A | 3/1999 | Wang et al. | |
| 5,940,031 | A | 8/1999 | Turlington et al. | |
| 6,552,691 | B2 | 4/2003 | Mohuchy et al. | |
| 6,650,291 | B1 * | 11/2003 | West | H01Q 3/46 342/371 |
| 7,642,979 | B2 * | 1/2010 | Hook | H01Q 13/0241 343/767 |

(Continued)

OTHER PUBLICATIONS

PCT Search Report and Written Opinion of the ISA for PCT/US2016/064054 dated Feb. 24, 2017; 13 Pages.

(Continued)

*Primary Examiner* — Hoang Nguyen

(74) *Attorney, Agent, or Firm* — Daly, Crowley, Mofford & Durkee, LLP

(57) ABSTRACT

An antenna is provided from a plurality of antenna elements, each having a pair of orthogonally coupled notch elements coupled to an interleaved stripline-to-slot feed structure. Each dual-polarized, interleaved tapered slot antenna element forms a building block and a plurality of such tapered slot antenna elements can be arranged to form a phased array antenna having a triangular lattice pattern. The phased array antenna is capable of receiving electromagnetic signals having orthogonal polarization and includes a feed structure which provides interconnections on a single plane. The structure of the tapered slot antenna structure provides wideband, wide scan performance, for multiple polarizations without requiring electrical continuity between adjacent notch antenna elements.

20 Claims, 6 Drawing Sheets

(56) References Cited

U.S. PATENT DOCUMENTS

| | | | | |
|---|---|---|---|---|
| 8,325,099 | B2 | 12/2012 | Cavener et al. | |
| 2006/0038732 | A1 | 2/2006 | DeLuca et al. | |
| 2011/0074649 | A1 | 3/2011 | Isom et al. | |
| 2011/0148725 | A1 | 6/2011 | Cavener et al. | |
| 2013/0099988 | A1* | 4/2013 | Guy | F16B 5/0614 343/770 |

OTHER PUBLICATIONS

Choung.; "Wideband Double-Slot Cross-Notch Antenna;" IEEE Antennas and Wireless Propagation Society International Symposium; vol. 2;Jul. 8-13, 2001; 4 pages.

Lee, et al.; "A Low-Profile Wide-Band (5:1) Dual-Pol Array;" IEEE Antennas and Wireless Propagation Letters; vol. 2; Issue 1; 2003; pp. 46-49 (4 pages).

Lee, et al.; Correction to "A Low-Profile Wide-Band (5:1) Dual-Pol Array;" IEEE Antennas and Wireless Propagation Letters; vol. 3; Issue 1; Dec. 2004; 1 page.

* cited by examiner

DUAL-POLARIZED WIDEBAND RADIATOR WITH SINGLE-PLANE STRIPLINE FEED

BACKGROUND

As is known in the art, phased array antennas (or more simply "phased arrays") are used in communication, radar, and direction-finding systems as well as in other multifunction radio frequency (RF) systems. Phased arrays are typically provided from many individual radiating antenna elements. The selection of the individual radiating element and arrangement of such elements have significant impact on the performance and cost of the phased array antenna.

As is also known, it is often desirable for the radiating elements to be capable of efficiently transmitting and receiving RF signals having multiple polarizations while at the same time exhibiting a low insertion loss characteristic, over a wide frequency bandwidth and a wide electronic scan volume.

One type of antenna element used to make a phased array antenna is called a tapered slot antenna element (also known as a "notch" antenna element). Notch antenna elements can have a relatively low insertion loss characteristic and can operate over a relatively wide frequency bandwidth and a relatively wide electronic scan volume.

Construction of such tapered slot phased array antennas, however, requires electrical continuity between elements. This makes difficult (and in some cases prohibits) the use of a triangular lattice pattern in a phased array, and also requires the use of feed structures having interconnects which are not disposed on a single plane (i.e. the feed structure is on multiple different layers of a multi-layer printed circuit board). This results in a phased array having a relatively complex physical architecture (e.g. complex feed structures and electronics packaging). Furthermore, the inability to use a triangular lattice combined with a complex feed structure results in increased cost and complexity in phased array antennas provided from notch antenna elements.

As is also known, there are a wide variety of tapered slot antenna designs having excellent performance characteristics. One published design described in Lee, J. J., Livingston S., and Koenig R. A Low-Profile Wide-Band (5:1) Dual-Pol Array, IEEE Antennas and Wireless Propagation Letters Vol. 2, 2003 eliminates the need for electrical continuity between antenna elements.

SUMMARY

In accordance with the concepts, systems, circuits and techniques described herein, it has been recognized that there is a need for a phased array antenna having a feed structure which provides radio frequency (RF) interconnections which lie along a single plane. Providing a phased array antenna having RF interconnections which lie along a single plane facilitates the connection of electronics to the phased array.

In accordance with one aspect of the concepts, systems, circuits, and techniques described herein, an antenna element comprises a pair of orthogonally disposed and interleaved notch antenna elements (or more simply notch elements) each of which is coupled to an interleaved stripline-to-slot feed structure.

With this particular arrangement, a phased array antenna capable of receiving electromagnetic signals having orthogonal polarizations and having a feed structure which provides interconnections on a single plane is provided.

Such a structure facilitates connections between the notch antenna elements and associated electronics and also allows use of a triangular lattice in a phased array antenna.

The structure of the notch antenna elements (also referred to as tapered slot antenna elements) provides wideband, wide scan performance, for multiple polarizations without requiring electrical continuity between adjacent notch antenna elements. Since electrical continuity between arms or fins of the notch antenna elements is not required, an aperture of a phased array antenna provided from a plurality of such elements can be arranged in a triangular lattice using modular construction techniques. Also, the tapered slot antenna structure described herein is compatible with the use of soft substrates. Furthermore, individual antenna element (or radiator) building blocks can be constructed using relatively simple multi-layer circuit card assembly (CCA) techniques. Also, the interleaved antenna element and feed structure described herein provides a low insertion loss path for the radiating element interconnections on a single plane, which simplifies the physical architecture and packaging for a phased array antenna, for example.

Embodiments of the concepts, circuits and techniques described herein may include one or more of the following features: a dual-polarized, interleaved, tapered slot antenna element having outputs in a single-plane to simplify connection to electronics. Such a dual-polarized, interleaved tapered slot antenna element forms a building block and a plurality of such tapered slot antenna elements can be arranged to form a phased array antenna having a triangular lattice pattern.

BRIEF DESCRIPTION OF THE DRAWINGS

The foregoing features may be more fully understood from the following description of the drawings in which.

DETAILED DESCRIPTION

The subject matter described herein relates to a dual-polarized, interleaved, tapered slot antenna element (also known as a "notch antenna element") having a stripline-to-slot feed structure. The combination of an interleaved notch element and stripline-to-slot feed structure results in an antenna capable of operating over a relatively wide bandwidth of approximately 30% (typical) and over a relatively wide scan angle of approximately 60 Degrees (typical). A plurality of dual-polarized, interleaved notch elements may be disposed to form a phased array. Since the notch antenna element described herein does not require electrical continuity between adjacent elements, a plurality of such dual-polarized, interleaved, notch antenna elements can be used in a modular construction technique to form a phased array antenna having a triangular lattice pattern and operable to receive electromagnetic signals having any polarizations.

Furthermore, by interleaving printed circuit boards on which the antenna elements and feed circuits are disposed (and thus referred to herein as "element boards") and appropriate placement of feed circuit signal paths on such printed circuit boards, input ports for the notch element radiator feed are in a single plane. This results in an array antenna which avoids feed dilation (i.e. offset feeds) and allows use of so-called "blind mate" connection techniques in coupling circuitry to the input ports of a phased array antenna. This enables connections to traditional transmit/receive (T/R) integrated microwave module (TRIMM) and/or slat architectures (where, for example the T/R module function requires implementation in two separate packages on opposite surfaces of a relatively long, thin radiator structure, thus giving rise to the name of a "slat" array). Furthermore, use of interleaved, dual polarized notch elements provided in accordance with the concepts, systems, circuits and techniques described herein, results in a phased antenna having coincident phase centers between dual-linear polarizations.

In the discussion that follows, a right-hand Cartesian coordinate system (CCS) will be assumed when describing the various antenna structures. To simplify description, the direction normal to the face of an antenna will be used as the z-direction of the CCS (with unit vector z), the direction along one side of the antenna will be used as the x-direction (with unit vector x), and the direction along an orthogonal side of the antenna will be used as the y direction (with unit vector y). It should be appreciated that the structures illustrated in the various figures disclosed herein are not necessarily to scale. That is, one or more dimensions in the figures may be exaggerated to, for example, increase clarity and facilitate understanding of the concepts, circuits and techniques described herein.

Figure 1:
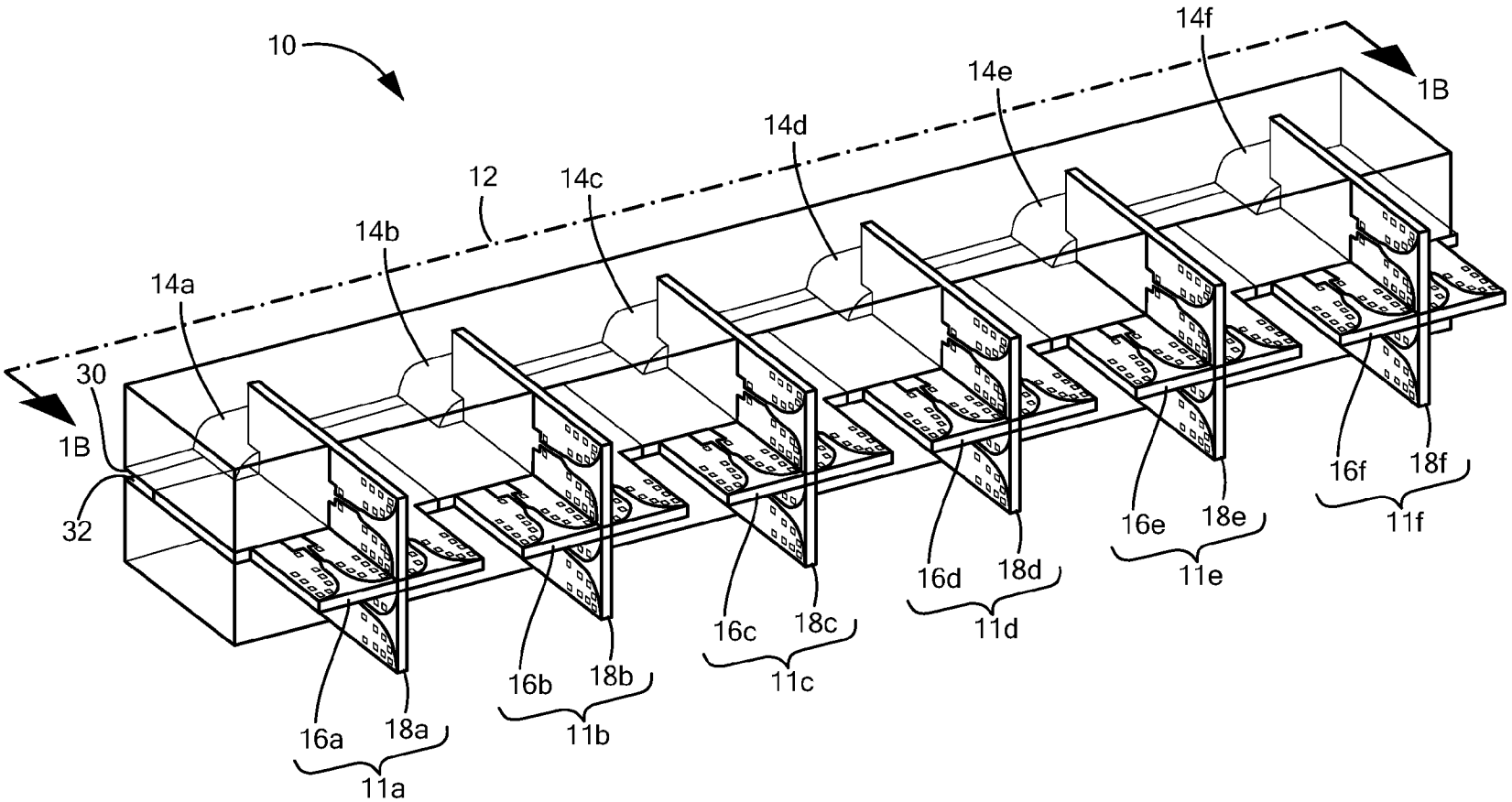
FIG. 1 is a front isometric view of a linear phased array antenna provided from a plurality of dual-polarized, interleaved slot antenna elements.
Figure 1A:
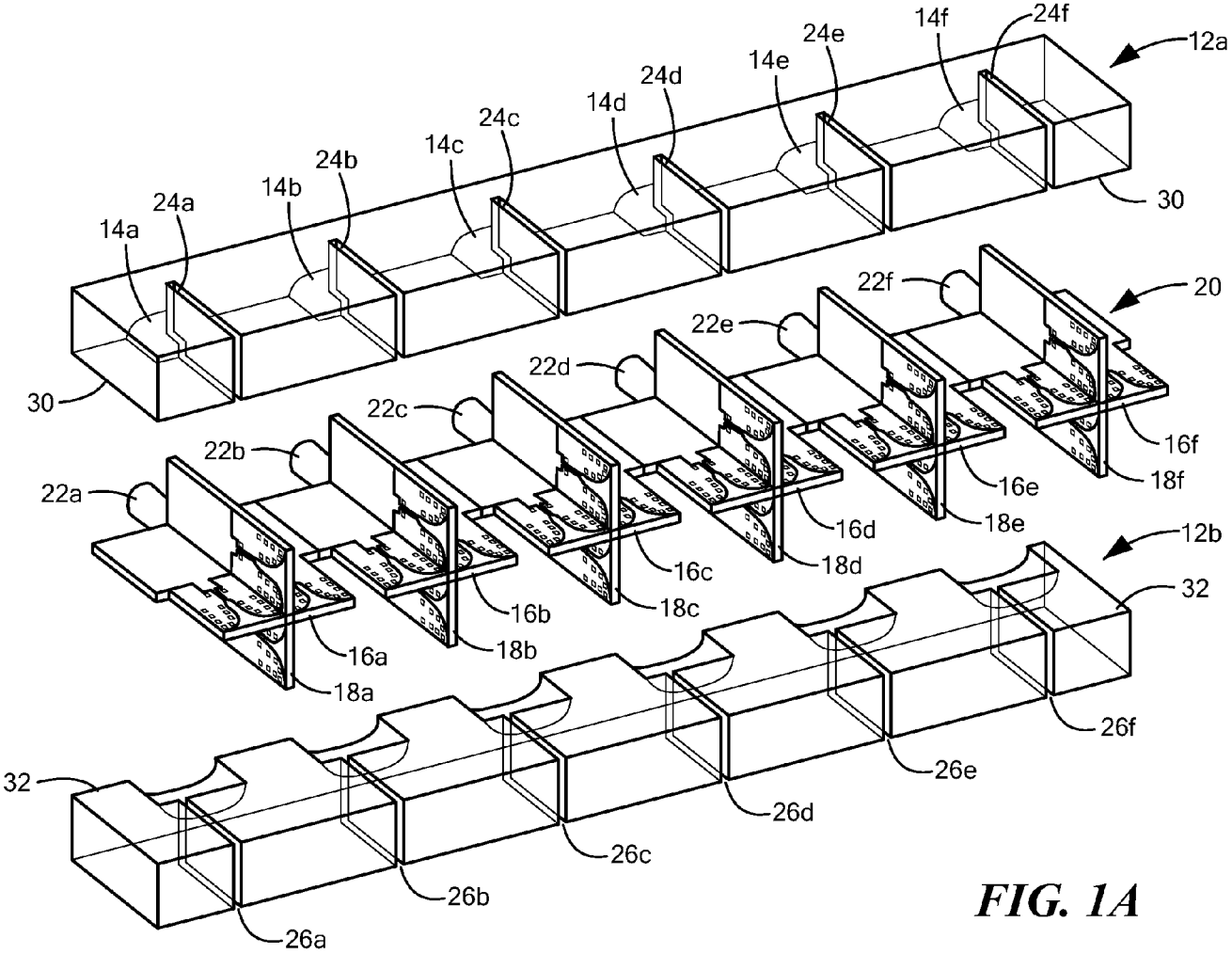
FIG. 1A is an isometric partially exploded view of the linear phased array antenna of FIG. 1.
Figure 1B:
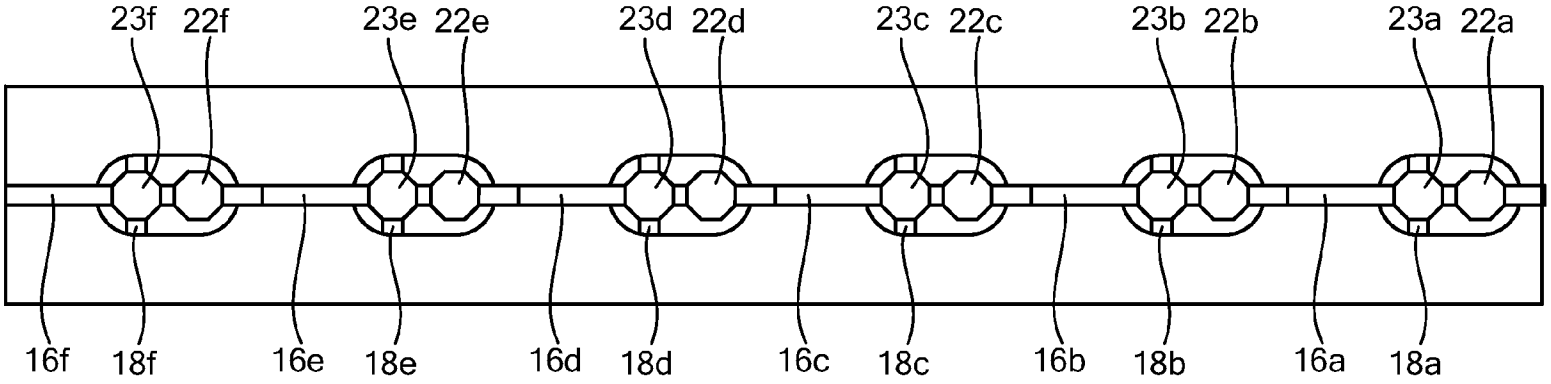
FIG. 1B is a rear view of the linear phased array antenna of FIG. 1.

Referring now to FIGS. 1-1B, in which like elements are provided having like reference designations throughout the several views, a linear phased array antenna 10 (or more simply, "phased array 10") includes a plurality of, here six, dual-polarized slot antenna elements 11*a*-11*f*, generally denoted 11, disposed within a housing 12. Although FIG. 1 illustrates the linear phased array antenna 10 with six dual-polarized slot antenna elements 11, it should be appreciated that any number of dual-polarized slot antenna elements 11 may be used according to a desired application. Those of ordinary skill in the art will appreciate how to select the appropriate number of elements to use in a phased array to meet the needs of a particular application.

In the illustrative embodiment of FIGS. 1-1B, each of the dual-polarized, slot antenna elements 11 includes a pair of interleaved (or interconnected) and orthogonally disposed element boards 16, 18. In this illustrative embodiment, dual polarized slot element 11 is provided from a first element board 16 (also referred to herein as a horizontal element board 16) and a second element board 18 (also referred to herein as a vertical element board 18). It should be appreciated that use of the terms "horizontal" and "vertical" are merely for identification purposes and should not be construed as limiting.

In some embodiments, the horizontal element board 16 and the vertical element board 18 each include one or more notch antenna elements. Each element board 16, 18 is thus provided having radiation pattern characteristics determined by the size and shape of a notch or slot in a radiating surface as is generally known.

By disposing one antenna element (e.g., horizontal board element 16) in one polarization direction and disposing a second antenna element (e.g. vertical board element 18) in the orthogonal polarization direction, a dual polarized antenna element responsive to signals having any polarization is provided. Furthermore, use of orthogonally disposed notch antenna elements (e.g. both a horizontal element and a vertical element) results in a radiating element having wideband and wide scan-angle performance for multiple polarizations.

By interleaving the horizontal element board 16 and vertical board element 18 and arranging the element boards 16, 18 (and thus antenna elements disposed thereon) at an angle of ninety degrees with respect to one another, a dual-polarized notch antenna element 11 having coincident phase centers is provided. Additionally, and as will become apparent from the description herein below in conjunction with FIGS. 3 and 3A, a plurality of such linear phased arrays 10 may be coupled together in an interleaved arrangement.

Figure 2:
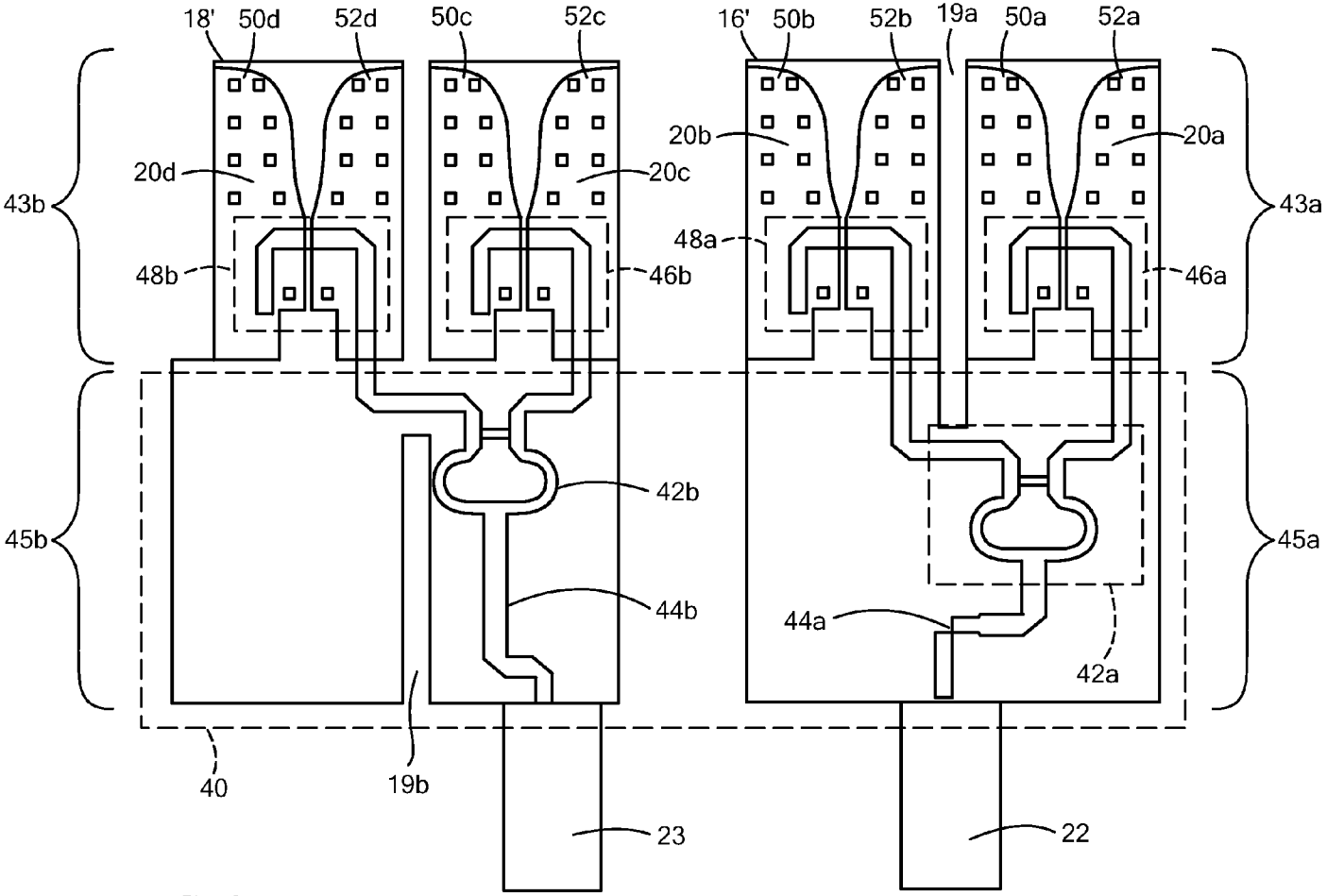
FIG. 2 is a top view of a slot antenna element and feed circuit.

To couple together horizontal and vertical element boards 16, 18, each element board 16*a*-16*f*, 18*a*-18*f* includes a receiving slot or other form of opening (e.g., slots 19*a*, 19*b* in FIG. 2). The receiving slots enable horizontal element board 16 and the vertical element board 18 to be coupled together in an interleaved manner which results in the dual polarized element 11 having coincident phase centers. In some embodiments, the receiving slot is positioned at a midpoint of the horizontal element board 16 and the vertical element board 18. It should be noted that the position and dimensions (i.e., length, width, depth) of the receiving slot for the horizontal element board 16 and the vertical element board 18 may vary according to the needs of a desired application. For example, in one embodiment and without limitation, the receiving slot may be formed into each of the horizontal element board 16 and the vertical element board 18 such that its length is one-half the total length of the horizontal element board 16 and the vertical element board 18 respectively. In such an embodiment, the horizontal element board 16 and the vertical element board 18 can be coupled together by aligning the receiving slot of one element board with a non-receiving slot portion of the other element board.

The dual-polarized slot antenna element 11 includes the housing 12 to cover and protect the internal components of the dual-polarized slot antenna element 11, including and without limitation, at least portions of the horizontal and vertical element boards 16, 18. The housing 12 may be formed or otherwise provided from a dielectric material or other form of electrically insulating material. In such embodiments, an electrically conductive material may be disposed over all or portions of surfaces of housing 12 to form a continuous ground surface for the element boards. The housing 12 may thus form an outer shell around the horizontal and vertical element boards 16, 18 and provides a ground plane for each individual antenna element, as illustrated in FIG. 1A.

Housing 12 includes an upper ground block 30 and a lower ground block 32. Upper and lower ground blocks 30, 32 are coupled to and secure the plurality of element boards 16, 18 which make up the dual-polarized slot antennas 11*a*-11*f* to allow for modular assembly and also to create a stripline feed network along the plane connecting the upper ground block 30 to the lower ground block 32.

The upper ground block 30 and lower ground block 32 provide ground continuity for the linear phased array antenna 10. The housing 12 may further include a connector body 14. The connector body 14 may be formed of the same material as the housing 12. In some embodiments, the connector body 14 covers and protects one or more connections to the dual-polarized slot antenna element 11 from a feed circuit.

To accept the dual-polarized slot antenna elements 11, the upper ground block 30 includes one or more openings or slots 24 to accept a top portion of element board 18 and the lower ground block 32 includes one or more slots 26 to accept a bottom portion of elements board 18. Slots 24, 26 thus secure element board 18 in housing 12.

The upper ground block 30 and the lower ground block 32 include a connector portion 14 to accept a connector 22 that is coupled to the dual-polarized slot antenna elements 11. In such an embodiment, the vertical elements board 18 is received within slot 24 of the upper ground block 30 and slot 26 of the lower ground block 32 and the horizontal elements board 16 is disposed on a plane between the upper ground block 30 and the lower ground block 32. The interleaved tapered slot antenna and feed circuit configuration of the dual-polarized slot antenna elements 11 provided between the upper ground block 30 and the lower ground block 32 allows for the connectors of each of the dual-polarized slot antenna elements 11 to be in a single plane.

For example, and as illustrated in FIG. 1B, horizontal connectors 22 are coupled to the horizontal elements board 16 and vertical connectors 23 coupled to the vertical elements board 18 are aligned in a single plane. The dual-polarized slot antenna elements 11 can be configured as building blocks or modules for the linear phased array antenna 10 to provide the connectors 22, 23 in the same plane. In an embodiment, having the connectors 22, 23 in a single plane provides the stripline feed network along that plane and enables connections to traditional TRIMM and SLAT architectures.

Referring now to FIG. 2, a horizontal board element 16' and a vertical board element 18', which may be the same as or similar to horizontal and vertical element boards 16, 18 described above in conjunction with FIGS. 1-1B, each include a radiator portion 43*a*-43*b* and a feed portion 45*a*, 45*b*.

In horizontal element board 16', radiator portion 43*a* includes first and second notch antenna elements 20*a*, 20*b*. Each of the notch antenna elements 20*a*, 20*b* include a first and second fin portions 50*a*,52*a*, 50*b*, 52*b*, respectively. First and second notch antenna elements 20*a*, 20*b* are adjacently disposed on a surface of element board 16 and spaced apart by a throat region between fin 50*a* and fin 52*b*.

Element board feed portion 45*a* includes a feed circuit 44*a* which coupled signals between a connector 22 and each of the first and second notch antenna elements 20*a*, 20*b*. Feed circuit 44*a* comprises a signal path having a first end coupled to connector 22 and a second end coupled to an input of a divider circuit 42*a*. In some embodiments, feed circuit 44*a* includes a miter to join two portions of the feed circuit 44*a* together. The miter may be a joint made between two portions of feed circuit 44*a*, or other portions of an element board 16, 18, formed at an angle of 90°, such that the line of junction bisects this angle. In response to signals provided to an input thereof, divider circuit 42 divides the signals and distributes the signal between the first and second notch antenna elements 20*a*, 20*b*. In some embodiments, power divider 42*a* may be provided as a Wilkinson power divider/splitter including a multi-section Wilkinson power divider/splitter. Other types of power dividers may also be used.

In an embodiment, the power divider 42*a* splits an input into at least two outputs that can be equally distributed amongst the at least two outputs. Outputs of divider circuit 42*a* are coupled to respective ones of first and second radiator feed circuit 46*a*, 48*a* here illustrated as radiator feed couplers 46*a*, 48*a* disposed on radiator portion 43*a* of element board 16'. For example, the power divider 42*a* may split an input received from the connector 22, via the signal path 44*a*, and distribute two output signals to first and second notch antenna element 20*a*, 20*b* via couplers 46*a*, 48*a*.

In vertical board element 18', radiator portion 43*b* includes first and second notch antenna elements 20*c*, 20*d*. Each of the notch antenna elements 20*c*, 20*d* include a first and second fin portions 50*c*, 52*c*, 50*d*, 52*d*, respectively. First and second notch antenna elements 20*c*, 20*d* are adjacently disposed on a surface of element board 18 and spaced apart by a throat region between fin 50*c* and fin 52*d*.

Element board feed portion 45*b* includes a feed circuit 44*b* which coupled signals between a connector 23 and each of the first and second notch antenna elements 20*c*, 20*d*. Feed circuit 44*b* comprises a signal path having a first end coupled to connector 23 and a second end coupled to an input of a divider circuit 42*b*. In response to signals provided to an input thereof, divider circuit 42*b* divides the signals and distributes the signal between the first and second notch antenna elements 20*c*, 20*d*. In some embodiments, power divider 42*b* may be provided as a Wilkinson power divider/splitter including a multi-section Wilkinson power divider/splitter. Other types of power dividers may also be used.

In an embodiment, the power divider 42*b* splits an input into at least two outputs that can be equally distributed amongst the at least two outputs. Outputs of divider circuit 42*b* are coupled to respective ones of first and second radiator feed circuit 46*b*, 48*b* here illustrated as radiator feed couplers 46*b*, 48*b* disposed on radiator portion 43*b* of element board 18'. For example, the power divider 42*b* may split an input received from the connector 23, via the signal path 44*b*, and distribute two output signals to first and second notch antenna element 20*c*, 20*d* via couplers 46*b*, 48*b*.

In some embodiments, feed portions 45*a*, 45*b* for both horizontal and vertical element boards 16', 18' is the portion that is covered by the housing 12 (e.g., upper ground block 30, lower ground block 32) as indicated by the phantom outline 40. The upper ground block 30 and lower ground block 32 operate as two ground planes that sandwich feed portions 45*a*, 45*b* creating the stripline feed network.

As previously described herein, the horizontal and vertical element boards 16' 18' can be coupled together to form the dual-polarized slot antenna element 11 from FIGS. 1-1B. In a pair of element boards (e.g., horizontal element board 16, vertical element board 18) that are to be coupled together, receiving slots 19*a*, 19*b* may be provided in opposing ends or sides with respect to the other board element. For example, horizontal element board 16 includes receiving slot 19*a* and vertical element board includes receiving slot 19*b*. In some embodiments, receiving slot 19*a* is provided in radiator portion 43*a* of horizontal element board 16, disposed between the first notch element 20*a* and the second notch element 20*b*, to accept a portion of the vertical element board 18. Receiving slot 19*b* of horizontal element board 16 can be provided in feed portion 45*b* to accept a portion of the horizontal element board 16. In such an embodiment, the horizontal element board 16 and vertical element board 18 can be interleaved together to align connectors 22, 23 in a single plane.

Figure 3:
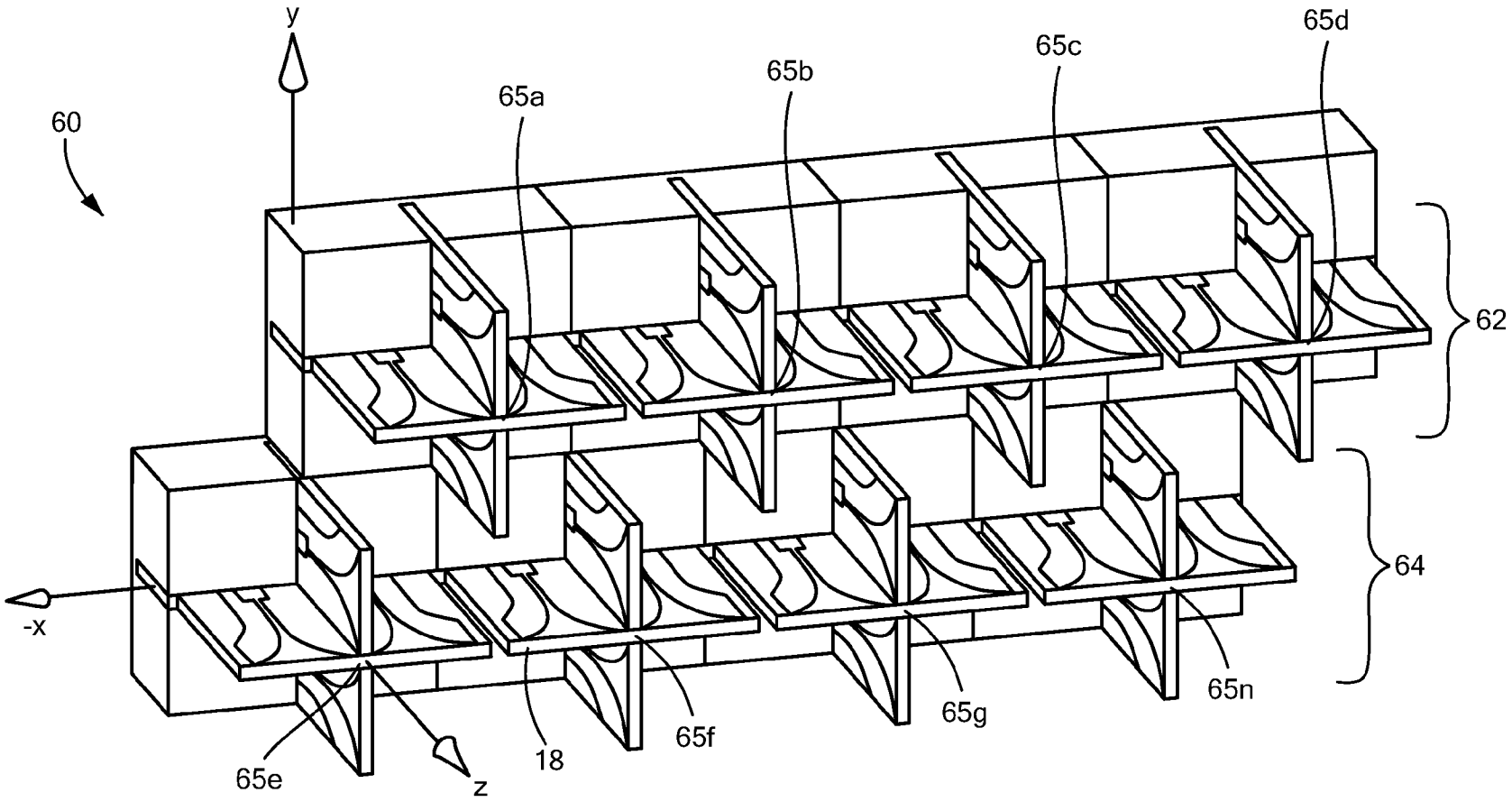
FIG. 3 is a front isometric view of a portion of a phased array antenna provided from a plurality of dual-polarized slot antenna elements arranged in a triangular lattice pattern.

Referring now to FIG. 3, a phased array antenna 60 is provided from a plurality of dual-polarized slot antenna elements 11. The phased array antenna 60 includes a first row of phased array antenna elements 62 and a second row of phased array antenna elements 64. Although FIG. 3 illustrates each of the first row and second row of phased array antenna elements 62,64 as having four dual-polarized slot antenna elements 11, it should be appreciated that any number of dual-polarized slot antenna elements 11 may be used in a particular row or construction of antenna elements according to a desired application. Additionally, any number of rows or construction of phased array antenna elements 62, 64 may be used according to a desired application.

In some embodiments, the dual-polarized slot antenna elements 11 of the first row of phased array antenna elements 62 are arranged such that they are offset with respect to a neighboring or adjacent row phased array antenna elements (e.g., the second row of phased array antenna elements 64) and in a triangular lattice pattern. The triangular lattice pattern (I.e., positioning of the antenna elements 11) allows for a reduced number of antenna elements required in the phased array antenna. The triangular lattice pattern generally refers intersection points 65 of horizontal board elements 16 and vertical board elements 18 of a first row with respect to intersection points 65 of horizontal board elements 16 and vertical board elements 18 of an adjacent row.

Phased array antenna 60 includes a plurality of intersection points 65*a*-65*h*, generally denoted 65. An intersection point 65 refers to the point at which the horizontal element board 16 and vertical element board 18 are in contact and coupled together. For example, and as illustrated in FIG. 3, the intersection points 65 of horizontal and vertical element boards 16, 18 of the first row of phased array antenna elements 62 are offset with respect to intersection points 65 of horizontal and vertical element boards 16, 18 of the second row of phased array antenna elements 64. In other words, the intersection points 65 of horizontal and vertical element boards 16, 18 of the first row of phased array antenna elements 62 are not positioned directly over the intersection points 65 of horizontal and vertical element boards 16, 18 of the second row of phased array antenna elements 64. The triangular lattice pattern improves affordability of the phased array antenna 60 and reduces the number of antenna elements required to populate the phased array antenna 60.

In the present application, because electrical continuity between dual-polarized slot antenna elements 11 is not required, an aperture of a phased array antenna 60 provided from the plurality of dual-polarized slot antenna elements 11 can be arranged in the triangular lattice pattern using modular construction techniques. For example, the dual-polarized slot antenna elements 11 can form building blocks and a plurality of these elements (i.e., first row of phased array antenna elements 62, second row of phased array antenna elements 64) can be arranged in various patterns including the triangular lattice pattern.

Figure 3A:
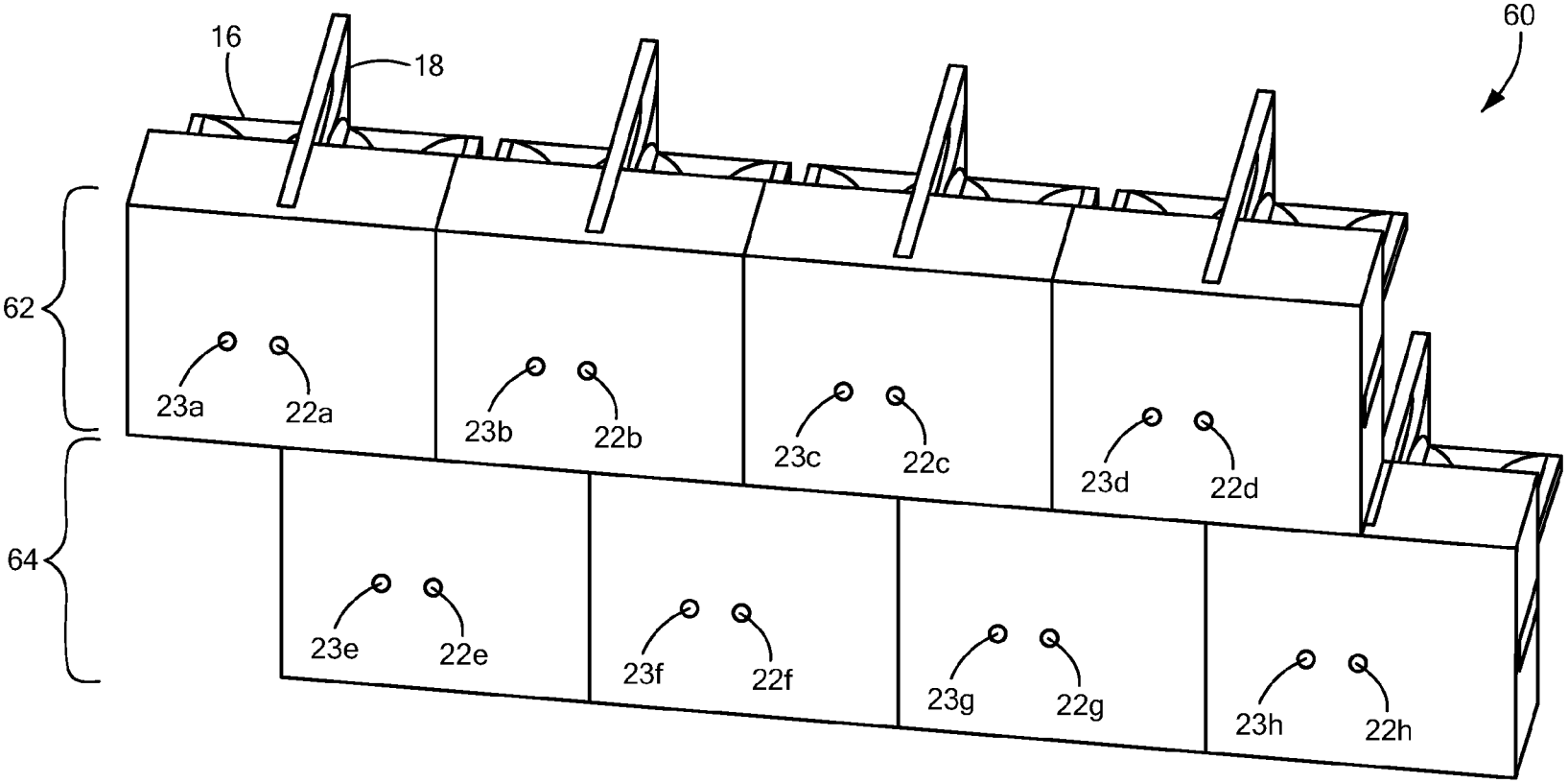
FIG. 3A is a rear isometric view of the phased array antenna shown in FIG. 3.

Referring now to FIG. 3A, connectors 22, 23 of phased array antenna 60 (FIG. 3) are coupled to respective ones first and second rows of phased array antenna elements 62, 64. Significantly, connectors 22, 23 are aligned in a single plane. The triangular lattice pattern can also be identified based on the alignment of the connectors 22, 23 of each dual-polarized slot antenna element 11 in phased array antenna 60. For example, and as illustrated in FIG. 3A, the connectors 22, 23 of each dual-polarized slot antenna element 11 of the first row of phased array antenna elements 62 are offset with respect to the connectors 22,23 of each dual-polarized slot antenna element 11 of the second row of phased array antenna elements 64.

The modular construction of the phased array antenna 60 using the dual-polarized slot antenna elements 11 allows for construction of phased array antenna having any size and shape. Furthermore, having the antenna elements 11 and connectors 22, 23 of each row aligned in the same plane simplifies both construction of a phased array antenna as well as connection of phased array outputs to other circuitry. This enables connections to traditional TRIMM and/or slat architectures (where, for example a T/R module function requires implementation in two separate packages on opposite surfaces of a relatively long, thin radiator structure, thus giving rise to the name of a "slat" array).

In general overview, described herein is an antenna comprising an interleaved stripline-to-slot feed structure with a modified tapered slot antenna. The modified tapered slot antenna structure provides wideband, wide scan performance, for multiple polarizations without requiring electrically continuity between adjacent antenna elements.

The antenna designs and design techniques described herein have application in a wide variety of different applications. For example, the antennas may be used as active or passive antenna elements for missile sensors that require bandwidth, higher gain to support link margin, and wide impedance bandwidth to support higher data-rates, within a small volume. They may also be used as antennas for land-based, sea-based, or satellite communications. Because antennas having small antenna volume are possible, the antennas are well suited for use on small missile airframes. The antennas may also be used in, for example, handheld communication devices, commercial aircraft communication systems, automobile-based communications systems (e.g., personal communications, traffic updates, emergency response communication, collision avoidance systems, etc.), Satellite Digital Audio Radio Service (SDARS) communications, proximity readers and other RFID structures, radar systems, global positioning system (GPS) communications, and/or others. In at least one embodiment, the antenna designs are adapted for use in medical imaging systems. The antenna designs described herein may be used for both transmit and receive operations. Many other applications are also possible.

It should of course be understood that while the present technology has been described with respect to disclosed embodiments, numerous variations, alternate embodiments, equivalents, etc. are possible without departing from the spirit and scope of the claims. For example, any of a number of elements may be used in the phased array.

In addition, it is intended that the scope of the present claims include all other foreseeable equivalents to the elements and structures as described herein and with reference to the drawing figures. Accordingly, the subject matter sought to be protected herein is to be limited only by the scope of the claims and their equivalents.

Having described preferred embodiments which serve to illustrate various concepts, structures and techniques, which are the subject of this patent, it will now become apparent to those of ordinary skill in the art that other embodiments incorporating these concepts, structures and techniques may be used. For example, it should be noted that individual concepts, features (or elements) and techniques of different embodiments described herein may be combined to form other embodiments not specifically set forth above. Furthermore, various concepts, features (or elements) and techniques, which are described in the context of a single embodiment, may also be provided separately or in any suitable sub-combination. It is thus expected that other embodiments not specifically described herein are also within the scope of the following claims.

Accordingly, it is submitted that that scope of the patent should not be limited to the described embodiments, but rather should be limited only by the spirit and scope of the following claims.

All publications and references cited herein are expressly incorporated herein by reference in their entirety.

What is claimed is:

1. An array antenna comprising:

a plurality of dual-polarized slot antenna elements, each of the plurality of dual-polarized slot antenna elements comprising:

a first element board having a radiating portion having one or more notch antenna elements disposed thereon and a having feed portion having a feed circuit disposed thereon and configured to provide signals to each of the one or more notch antenna elements disposed on the radiating portion of the first element board and having a slot provided in a first one of the radiating or feed portions of the first element board;

a second element board having a radiating portion having one or more notch antenna elements disposed thereon and a having feed portion having a feed circuit disposed thereon and configured to provide signals to each of the one or more notch antenna elements disposed on the radiating portion of the second element board and having a slot provided in a second one of the radiating or feed portions of the second element board with the slot of the first element board engaged with the slot of the second element such that the first and second element boards are interleaved and are orthogonally disposed; and an upper ground block and a lower ground block coupled to the plurality of dual polarized slot antennas, wherein the upper ground block and the lower ground block provide a ground continuity for the antenna.

2. The antenna of claim 1, wherein each of the feed circuits include a feed circuit output and wherein each of the outputs of the feed circuits of the first and second element boards are offset such that the feed circuit outputs for each of the plurality of dual-polarized slot antenna elements are disposed in a single plane.

3. The antenna of claim 1, wherein:

the first element board comprises a pair of notch antenna elements disposed thereon; and the feed circuit comprises:

a divider circuit having an input coupled to the feed circuit output and having a pair of outputs; and a first coupler coupled between a first one of the divider circuit outputs and a first one of the pair of notch antenna elements; and a second coupler coupled between a second one of the divider circuit outputs and a second one of the pair of notch antenna elements.

4. The antenna of claim 1, wherein the radiator portion of the horizontal board element and the vertical board element include a first notch antenna element and a second notch antenna element.

5. The antenna of claim 4, wherein each of the first notch antenna element and the second notch antenna element includes a first fin, a second fin and a throat region between the first fin and the second fin.

6. The antenna of claim 5, wherein the horizontal board element includes a receiving slot in the radiator portion and disposed between the first fin and the second fin to accept the feed portion of the vertical board element.

7. The antenna of claim 5, wherein the vertical board element includes a receiving slot in the feed portion to accept the radiator portion of the horizontal board element.

8. The antenna of claim 1, further comprising one or more connectors coupled to the horizontal board element and the vertical board element, each of the connectors in the same plane.

9. The antenna of claim 1, further comprising one or more rows of the plurality of dual-polarized slot antennas, wherein each row of the plurality of dual-polarized slot antennas are arranged in the interleaved stripline-to-slot feed structure with respect to an adjacent row.

10. The antenna of claim 9, wherein the one or more rows of the plurality of dual-polarized slot antennas are arranged in a triangular lattice pattern.

11. The antenna of claim 1 wherein said upper ground block and said lower ground block sandwich said feed portions and provide a stripline feed network in two orthogonal directions of a plane connecting the upper ground block to the lower ground block.

12. An array antenna comprising:

a plurality or rows of dual-polarized slot antenna elements, each of the plurality of dual-polarized slot antenna elements comprising:

a first element board having a radiating portion having one or more notch antenna elements disposed thereon and a having feed portion having a feed circuit disposed thereon and configured to provide signals to each of the one or more notch antenna elements disposed on the radiating portion of the first element board and having a slot provided in a first one of the radiating or feed portions of the first element board;

a second element board having a radiating portion having one or more notch antenna elements disposed thereon and a having feed portion having a feed circuit disposed thereon and configured to provide signals to each of the one or more notch antenna elements disposed on the radiating portion of the second element board and having a slot provided in a second one of the radiating or feed portions of the second element board with the slot of the first element board engaged with the slot of the second element such that the first and second element boards are interleaved and are orthogonally disposed;

wherein each row of the plurality of rows of dual-polarized slot antennas are arranged in the interleaved stripline-to-slot feed structure with respect to an adjacent row; and an upper round block and a lower ground block coupled to the plurality of dual polarized slot antennas, wherein the upper round block and the lower ground block provide a ground continuity for the antenna.

13. The antenna of claim 12 wherein the plurality of rows of dual-polarized slot antennas are arranged in a triangular lattice pattern.

14. The antenna of claim 12, wherein each of the feed circuits include a feed circuit output and wherein each of the outputs of the feed circuits of the first and second element boards are offset such that the feed circuit outputs for each of the plurality of dual-polarized slot antenna elements are disposed in a single plane.

15. The antenna of claim 12, wherein:

the first element board comprises a pair of notch antenna elements disposed thereon; and the feed circuit comprises:

a divider circuit having an input coupled to the feed circuit output and having a pair of outputs; and a first coupler coupled between a first one of the divider circuit outputs and a first one of the pair of notch antenna elements; and a second coupler coupled between a second one of the divider circuit outputs and a second one of the pair of notch antenna elements.

16. The antenna of claim 12, wherein the horizontal board element and the vertical board element in each of the dual-polarized slot antennas are orthogonally disposed with respect to each other.

17. The antenna of claim 12, wherein the horizontal board element and the vertical board element include a radiator portion and a feed portion, and wherein the radiator portion of the horizontal board element and the vertical board element include a first notch antenna element and a second notch antenna element.

18. The antenna of claim 17, wherein each of the first notch antenna element and the second notch antenna element includes a first fin, a second fin and a throat region between the first fin and the second fin.

19. The antenna of claim 18, wherein the horizontal board element includes a receiving slot in the radiator portion and disposed between the first fin and the second fin to accept the feed portion of the vertical board element and wherein the vertical board element includes a receiving slot in the feed portion to accept the radiator portion of the horizontal board element.

20. The antenna of claim 12 wherein said upper ground block and said lower ground block sandwich said feed portions and provide a stripline feed network in two orthogonal directions of a plane connecting the upper ground block to the lower ground block.

* * * * *